US009191731B2

(12) United States Patent
Huang et al.

(10) Patent No.: US 9,191,731 B2
(45) Date of Patent: Nov. 17, 2015

(54) DUAL-FREQUENCY COAXIAL EARPHONE

(71) Applicant: Jetvox Acoustic Corp., Taoyuan County (TW)

(72) Inventors: Ying-Shin Huang, Taoyuan County (TW); To-Teng Huang, Taoyuan County (TW)

(73) Assignee: Jetvox Acoustic Corp., Taoyuan, Taoyuan County (TW)

( * ) Notice: Subject to any disclaimer, the term of this patent is extended or adjusted under 35 U.S.C. 154(b) by 161 days.

(21) Appl. No.: 14/063,253

(22) Filed: Oct. 25, 2013

(65) Prior Publication Data

US 2014/0169583 A1 Jun. 19, 2014

(30) Foreign Application Priority Data

Dec. 13, 2012 (TW) ..... 101224176 U
Dec. 20, 2012 (TW) ..... 101224673 U

(51) Int. Cl.

| | |
|---|---|
| ***H04R 1/10*** | (2006.01) |
| ***H04R 1/24*** | (2006.01) |
| ***H04R 9/06*** | (2006.01) |
| ***H04R 11/02*** | (2006.01) |

(52) U.S. Cl.

CPC ..... *H04R 1/1058* (2013.01); *H04R 1/1075* (2013.01); *H04R 1/24* (2013.01); *H04R 9/06* (2013.01); *H04R 11/02* (2013.01)

(58) Field of Classification Search

None

See application file for complete search history.

(56) References Cited

U.S. PATENT DOCUMENTS

2009/0279729 A1 11/2009 Huang
2010/0046783 A1 2/2010 Huang
2010/0278371 A1* 11/2010 Hanada ..... 381/398

FOREIGN PATENT DOCUMENTS

CN 201426165 Y 3/2010
CN 201682603 U 12/2010

(Continued)

OTHER PUBLICATIONS

Anonymous: Acoustic Interface Design Guide 2010, Apr. 1, 2010, pp. 1-32, XP055181048, URL: http://www.farnell.com/datasheets/924828.pdf [last retrieved on Apr. 2, 2015].

(Continued)

*Primary Examiner* — Paul Huber

(74) *Attorney, Agent, or Firm* — Muncy, Geissler, Olds & Lowe, P.C.

(57) ABSTRACT

A dual-frequency coaxial earphone includes an earphone housing, a moving coil loudspeaker unit and a balanced armature loudspeaker unit. The earphone housing has a receiving space and an acoustic output orifice. The receiving space communicates with the acoustic output orifice. The moving coil loudspeaker unit is assembled in the receiving space and includes a moving coil vibrating diaphragm and an acoustic transmitting member. The moving coil vibrating diaphragm is assembled to face the acoustic output orifice and includes a central vibrating portion. The acoustic transmitting member includes an acoustic transmitting hole corresponding to the central vibrating portion. The balanced armature loudspeaker corresponds to the moving coil loudspeaker unit and includes an armature vibrating diaphragm. The armature vibrating diaphragm corresponds to the acoustic transmitting hole, so that the armature vibrating diaphragm and the moving coil vibrating diaphragm are respectively disposed at two ends of the acoustic transmitting member.

18 Claims, 9 Drawing Sheets

(56) References Cited

FOREIGN PATENT DOCUMENTS

| | | | |
|---|---|---|---|
| EP | 2101512 | A1 | 9/2009 |
| KR | 10-0677953 | | 1/2007 |
| KR | 20-2010-0002262 | | 3/2010 |
| KR | 101177322 | B2 | 8/2012 |
| KR | 10-1185803 | | 9/2012 |

OTHER PUBLICATIONS

Anonymous: vol. 2 Balanced Armature 2 Type, Technical Information—Backnumbers, May 20, 2007, pp. 1-5, XP055181029, URL: http://www.yashima-elec.co.jp/e/technical_information/backnumber002.html. [last retrieved on Apr. 2, 2015].

* cited by examiner

DUAL-FREQUENCY COAXIAL EARPHONE

CROSS-REFERENCES TO RELATED APPLICATIONS

This non-provisional application claims priority under 35 U.S.C. §119(a) on Patent Application No. 101224176 and 101224673, filed in Taiwan, R.O.C. on 2012 Dec. 13 and 2012 Dec. 20, the entire contents of which are hereby incorporated by reference.

BACKGROUND

1. Technical Field

The disclosure relates to an earphone structure, and particularly to a dual-frequency coaxial earphone.

2. Related Art

As shown in FIG. 1, a conventional earphone casing A10 has a signal cable A1, a vibrating diaphragm A2, a permanent magnet A3, a voice coil A4, a magnet conducting member A5 and a yoke A6 assembled therein. The voice coil A4 is assembled on the vibrating diaphragm A2 and encloses a periphery of the permanent magnet A3. A radial gap is defined between the voice coil A4 and the magnet conducting member A5. The permanent magnet A3 is sandwiched between the magnet conducting member A5 and the yoke A6.

The signal cable A1 is connected electrically to the voice coil A4. When an acoustic signals are inputted to the voice coil A4 via the signal cable A1, the voice coil A4 generates a magnet field via electromagnetic effect firstly, and then the magnet field is interacted with the magnet conducting member A5 via magnetic forces so as to drive the vibrating diaphragm A2 to vibrate, so that the acoustic signals are converted to acoustic waves for output.

As in the conventional earphone, generally the acoustic signals includes high frequency acoustic signals and low frequency acoustic signals, so both the high frequency acoustic waves and the low frequency acoustic waves will be generated when the vibrating diaphragm A2 vibrates. However, since the high frequency acoustic waves and the low frequency acoustic waves have different wavelengths and amplitudes, the characters of the two different acoustic waves cannot be distinguished by only one vibrating diaphragm A2, so that in a conventional earphone, the high frequency acoustic waves and the low frequency acoustic waves has intermodulation distortion drawbacks thereby the voices cannot be presented clearly. Although some earphone manufacturers want to assemble the high frequency speaker and the low frequency speaker into the conventional earphone so as to output the high frequency acoustic waves and the low frequency acoustic waves individually, the size of the conventional earphone is not appropriate for such modification.

SUMMARY

In view of this, one invention concept of the disclosure provides a dual-frequency coaxial earphone. The dual-frequency coaxial earphone includes an earphone housing, a moving coil loudspeaker unit and a balanced armature loudspeaker unit. The earphone housing has a receiving space and an acoustic output orifice. The receiving space communicates with the acoustic output orifice. The moving coil loudspeaker unit is assembled in the receiving space and includes a moving coil vibrating diaphragm and an acoustic transmitting member. The moving coil vibrating diaphragm is assembled to face the acoustic output orifice and includes a central vibrating portion. The acoustic transmitting member includes an acoustic transmitting hole corresponding to the central vibrating portion. The balanced armature loudspeaker corresponds to the moving coil loudspeaker unit and includes an armature vibrating diaphragm. The armature vibrating diaphragm corresponds to the acoustic transmitting hole, so that the armature vibrating diaphragm and the moving coil vibrating diaphragm are respectively disposed at two ends of the acoustic transmitting member. High frequency acoustic waves generated from the armature vibrating diaphragm are transmitted to the central vibrating portion through the acoustic transmitting hole so as to supplement high acoustic frequency extensions the moving coil vibrating diaphragm lacks.

Another invention concept of the disclosure provides a dual-frequency coaxial earphone. The dual-frequency coaxial earphone includes an earphone housing, a moving coil loudspeaker unit and a balanced armature loudspeaker unit. The earphone housing has a receiving space and an acoustic output orifice. The receiving space communicates with the acoustic output orifice. The moving coil loudspeaker unit is assembled in the receiving space and includes a moving coil vibrating diaphragm and an acoustic transmitting member. The moving coil vibrating diaphragm is assembled to face the acoustic output orifice and includes a central vibrating portion. The acoustic transmitting member includes an acoustic transmitting hole corresponding to the central vibrating portion. The balanced armature loudspeaker unit is disposed in the acoustic transmitting hole and includes an armature vibrating diaphragm corresponding to the moving coil vibrating diaphragm. High frequency acoustic waves generated from the armature vibrating diaphragm are transmitted to the central vibrating portion through the acoustic transmitting hole so as to supplement high acoustic frequency extensions the moving coil vibrating diaphragm lacks.

According to the disclosure, the balanced armature loudspeaker unit is securely assembled to the rear end of the moving coil loudspeaker unit, so that the balanced armature loudspeaker unit and the moving coil loudspeaker unit are formed integrally as a whole; or, the balanced armature loudspeaker unit is securely assembled in the acoustic transmitting hole of the moving coil loudspeaker unit, so that the balanced armature loudspeaker unit and the moving coil loudspeaker unit are formed integrally as a whole. Based on this, because the acoustic waves generated from the balanced armature loudspeaker unit are transmitted to the central vibrating portion of the moving coil loudspeaker unit directly or through the acoustic transmitting hole, the acoustic waves generated from the balanced armature loudspeaker unit and the acoustic waves generated from the moving coil loudspeaker unit have the same phase and are outputted simultaneously, and the different frequencies from the balanced armature loudspeaker unit and the moving coil loudspeaker unit can be separated, so that the intermodulation distortion issue between the high acoustic frequency and the low acoustic frequency can be efficiently improved while the size of the earphone is miniaturized.

The detailed features and advantages of the disclosure are described below in great detail through the following embodiments, the content of the detailed description is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein.

DETAILED DESCRIPTION

Figure 1:
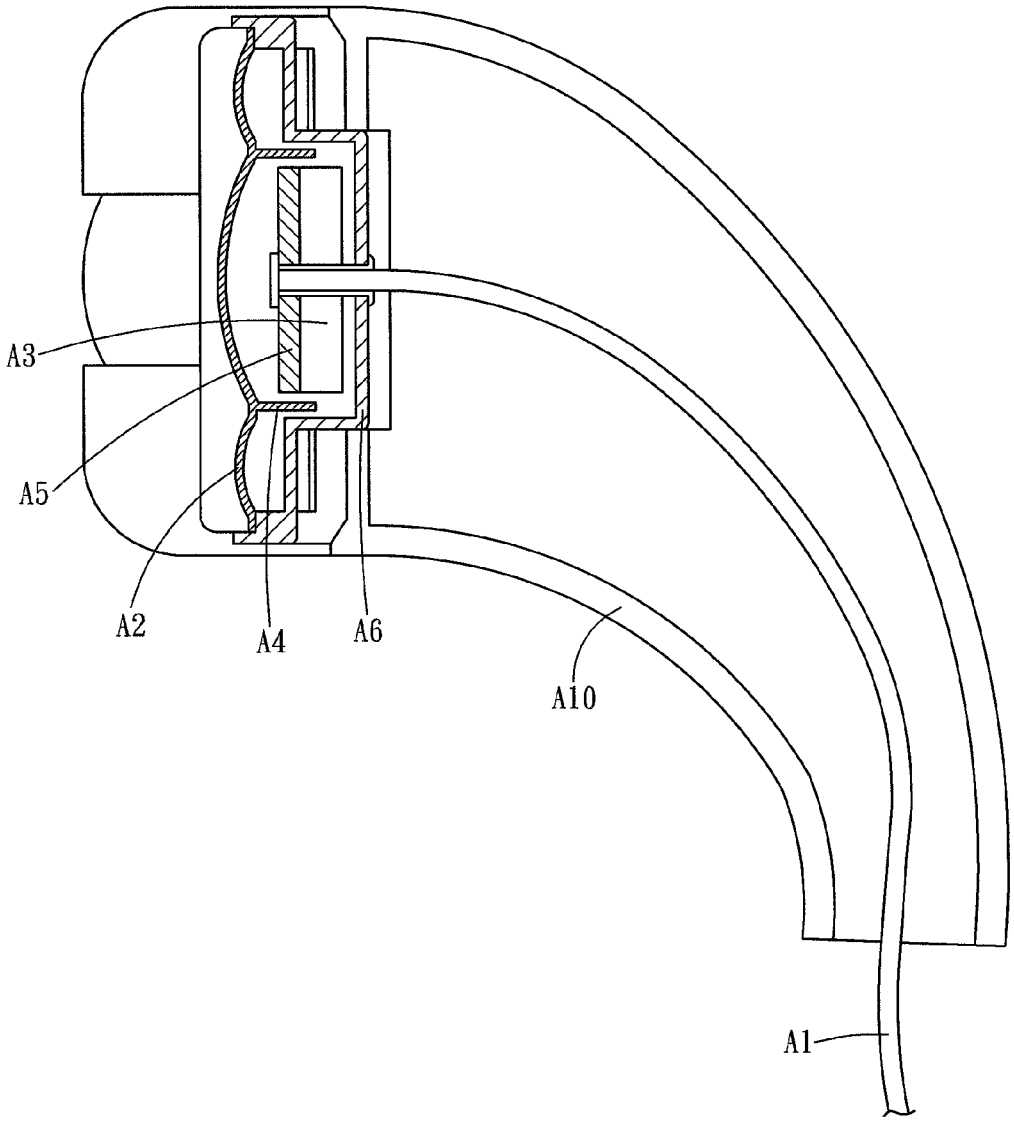
FIG. 1 (Prior Art)
FIG. 1 is a perspective view of a conventional earphone.
Figure 2:
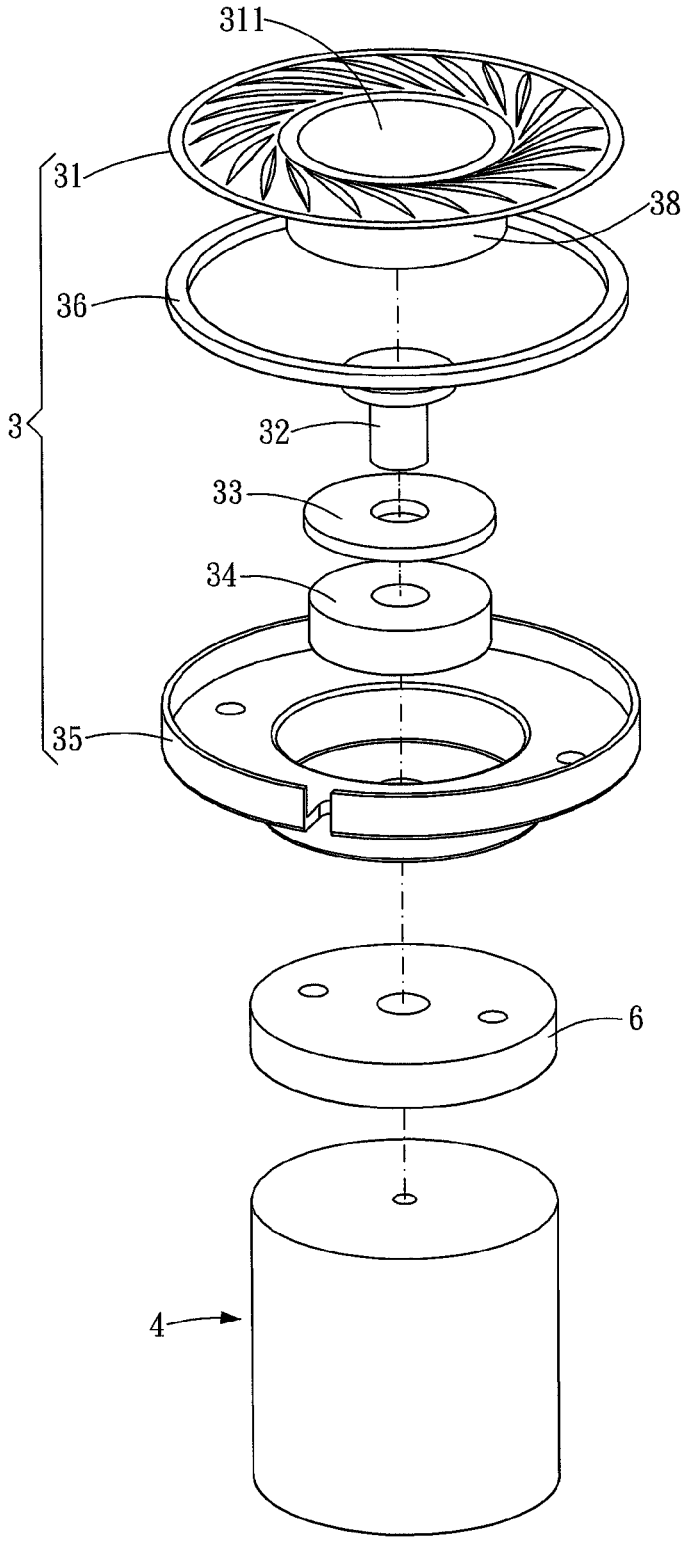
FIG. 2 is an exploded view of a dual-frequency coaxial earphone of a first embodiment.
Figure 3:
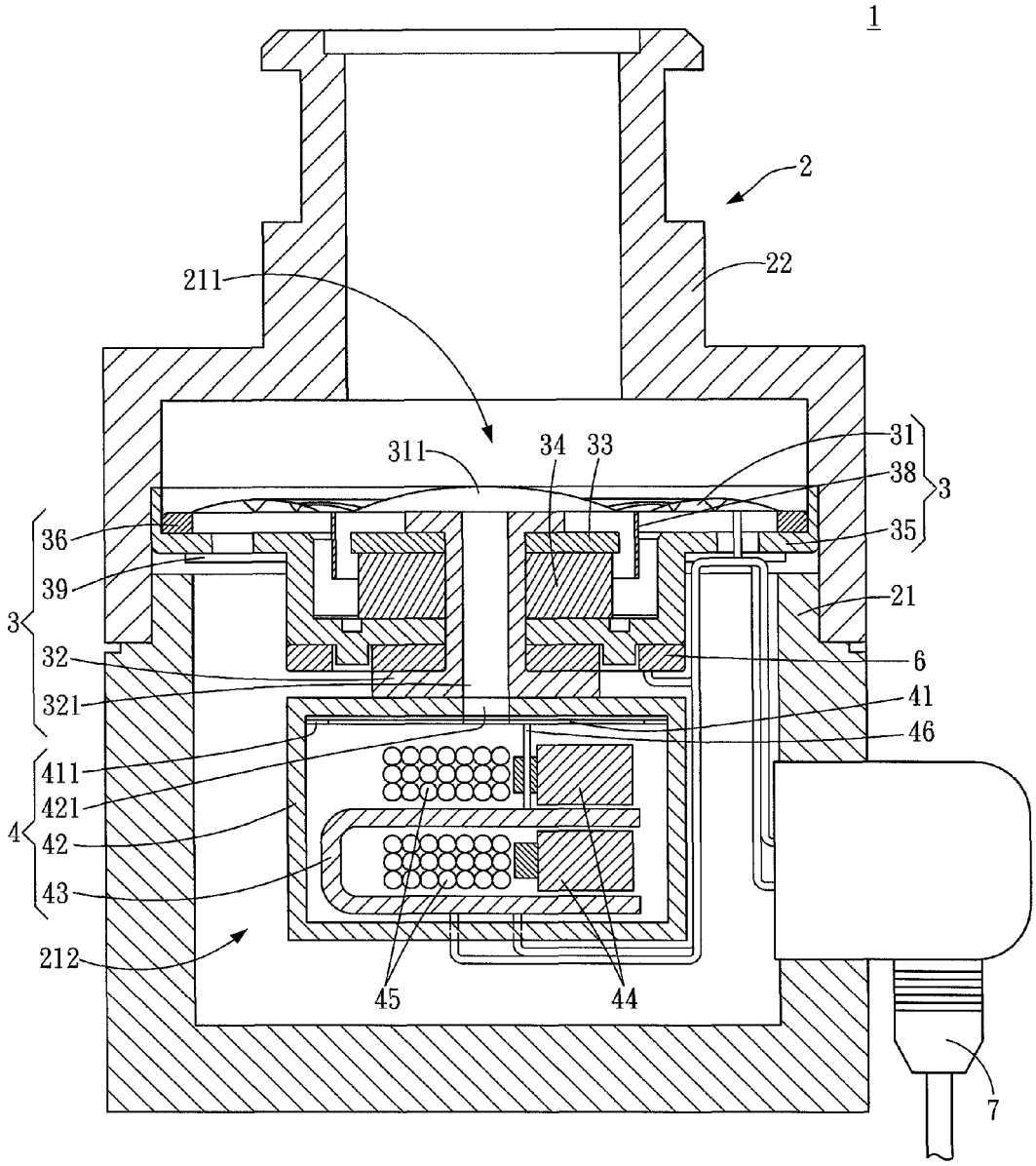
FIG. 3 is a cross-sectional view of the dual-frequency coaxial earphone of the first embodiment.

FIG. 2 and FIG. 3 show a first embodiment of a dual-frequency coaxial earphone of the disclosure. FIG. 2 is an exploded view of the first embodiment of the disclosure and FIG. 3 is a cross-sectional view of the first embodiment of the disclosure.

The dual-frequency coaxial earphone 1 in accordance with the first embodiment of the disclosure includes an earphone casing 2, a moving coil loudspeaker unit 3 and a balanced armature loudspeaker unit 4.

The earphone casing 2 is substantially consisting of a base 21 and a front cap 22. The base 21 has an acoustic output orifice 211. A receiving space 212 is defined in the base 21, and the receiving space 212 communicates with the acoustic output orifice 211. The front cap 22 is assembled at the acoustic output orifice 211.

The moving coil loudspeaker unit 3 is disposed in the receiving space 212 and has a moving coil vibrating diaphragm 31 and an acoustic transmitting member 32. The moving coil vibrating diaphragm 31 is assembled to face to the acoustic output orifice 211 and includes a central vibrating portion 311. The acoustic transmitting member 32 is formed as a hollow structure and has an acoustic transmitting hole 321 opened therein. Additionally, the acoustic transmitting hole 321 corresponds to the central vibrating portion 311. Preferably, the acoustic transmitting hole 321 corresponds to the center of the central vibrating portion 311.

The balanced armature loudspeaker unit 4 is securely assembled at the rear end of the moving coil loudspeaker unit 3, so that the moving coil loudspeaker unit 3 and the balanced armature loudspeaker unit 4 are integrally formed as a whole. That is, the acoustic output orifice 211 is faced to one end of the moving coil loudspeaker unit 3 and the balanced armature loudspeaker unit 4 is securely assembled at the other end of the moving coil loudspeaker unit 3. The balanced armature loudspeaker unit 4 includes an armature vibrating diaphragm 41. The armature vibrating diaphragm 41 corresponds to the acoustic transmitting hole 321, so that the armature vibrating diaphragm 41 and the moving coil vibrating diaphragm 31 are disposed at two ends of the acoustic transmitting member 32, respectively. Preferably, the acoustic transmitting hole 321 corresponds to the center of the armature vibrating diaphragm 41, so that the center of the armature vibrating diaphragm 41 corresponds to the center of the moving coil vibrating diaphragm 31. In addition, as shown in FIG. 3, preferably the center of the armature vibrating diaphragm 41 and the center of the moving coil vibrating diaphragm 31 are located on the axis line of the acoustic transmitting hole 321, but embodiments of the disclosure are not limited thereto.

Consequently, the high frequency acoustic waves generated from the armature vibrating diaphragm 41 are transmitted to the central vibrating portion 311 through the acoustic transmitting hole 321 so as to supplement the high acoustic frequency extensions the moving coil vibrating diaphragm 31 lacks. Additionally, the acoustic frequency of the balanced armature loudspeaker unit 4 and the acoustic frequency of the moving coil loudspeaker unit 3 have the same phase and are outputted simultaneously, so that the different frequencies from the balanced armature loudspeaker unit 4 and the moving coil loudspeaker unit 3 can be separated, and the intermodulation distortion issue between the high acoustic frequency and the low acoustic frequency can be efficiently improved with the size of the earphone being miniaturized.

In this embodiment, the moving coil loudspeaker unit 3 further includes a washer 33, an annular magnet 34, an outer yoke 35, a fastening ring 36, a moving voice coil 38 and an acoustic impedance material 39. The annular magnet 34 is disposed on the outer yoke 35 and the washer 33 is disposed on the surface of the annular magnet 34. The washer 33, the annular magnet 34 and the outer yoke 35 are riveted by the acoustic transmitting member 32 and formed integrally as a whole, as shown in FIG. 3. The fastening ring 36 is assembled on the outer yoke 35 to fasten the moving coil vibrating diaphragm 31. The moving voice coil 38 is assembled on the moving coil vibrating diaphragm 31, and the washer 33 is sleeved to the inner side of the moving voice coil 38. Parts of the outer periphery of the moving voice coil 38 are disposed on the outer yoke 35. The acoustic impedance material 39 is assembled on parts of the outer periphery of the outer yoke 35.

In this embodiment, the balanced armature loudspeaker unit 4 further includes a casing 42, an armature 43, an armature magnet 44, an armature voice coil 45 and a linking-up member 46. The armature magnet 44 and the armature voice coil 45 are parallel assembled in the casing 42. The armature 43 is approximately formed as a U-shaped structure, and one end of the armature 43 is inserted into the armature magnet 44 and the armature voice coil 45, and the other end of the armature 43 is disposed to the one side of the armature magnet 44 and that of the armature voice coil 45. The linking-up member 46 connects to the armature magnet 44 and the armature vibrating diaphragm 41 so as to drive the armature vibrating diaphragm 41 to vibrate to generate acoustic waves. In addition, each of the two ends of the armature vibrating diaphragm 41 has a flange 411 fixed at the inner wall of the casing 42, so that the armature vibrating diaphragm 41 is fastened in the casing 42. Furthermore, the casing 42 further has an acoustic output hole 421 corresponding to the center of the armature vibrating diaphragm 41.

Additionally, the moving coil loudspeaker unit 3 has a circuit board 6 assembled on the outer yoke 35 thereof. The circuit board 6 has a frequency dividing circuit assembled thereon to divide the frequency-mixed input signals of the signal cable 7 into the high frequency output signals and the low frequency output signals to apply for the armature voice coil 45 and the moving voice coil 38, respectively.

Here, the structures of the moving coil loudspeaker unit 3 and the balanced armature loudspeaker unit 4 described above are only examples, but embodiments of the disclosure are not limited thereto.

Figure 4:
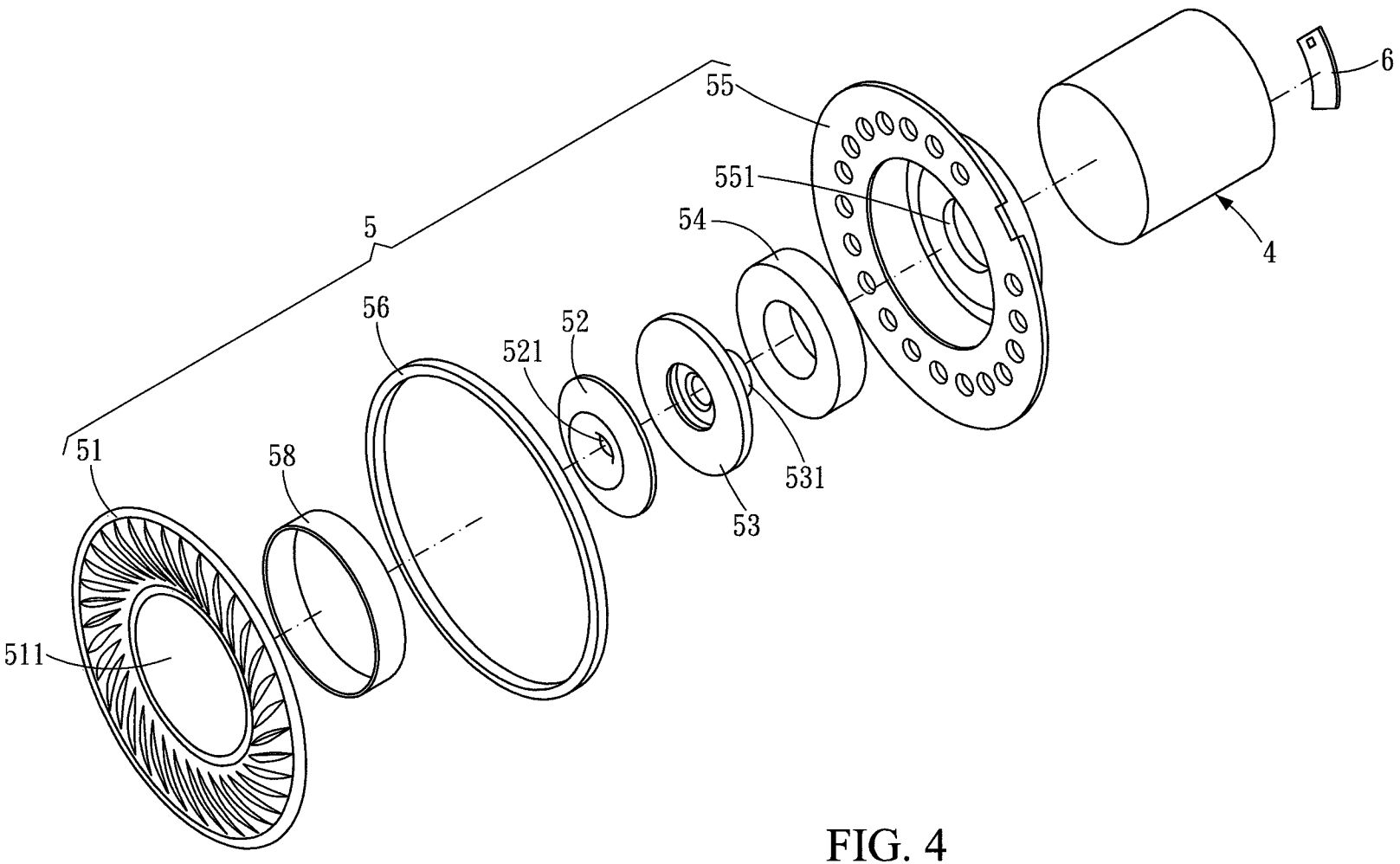
FIG. 4 is an exploded view of a dual-frequency coaxial earphone of a second embodiment.
Figure 5:
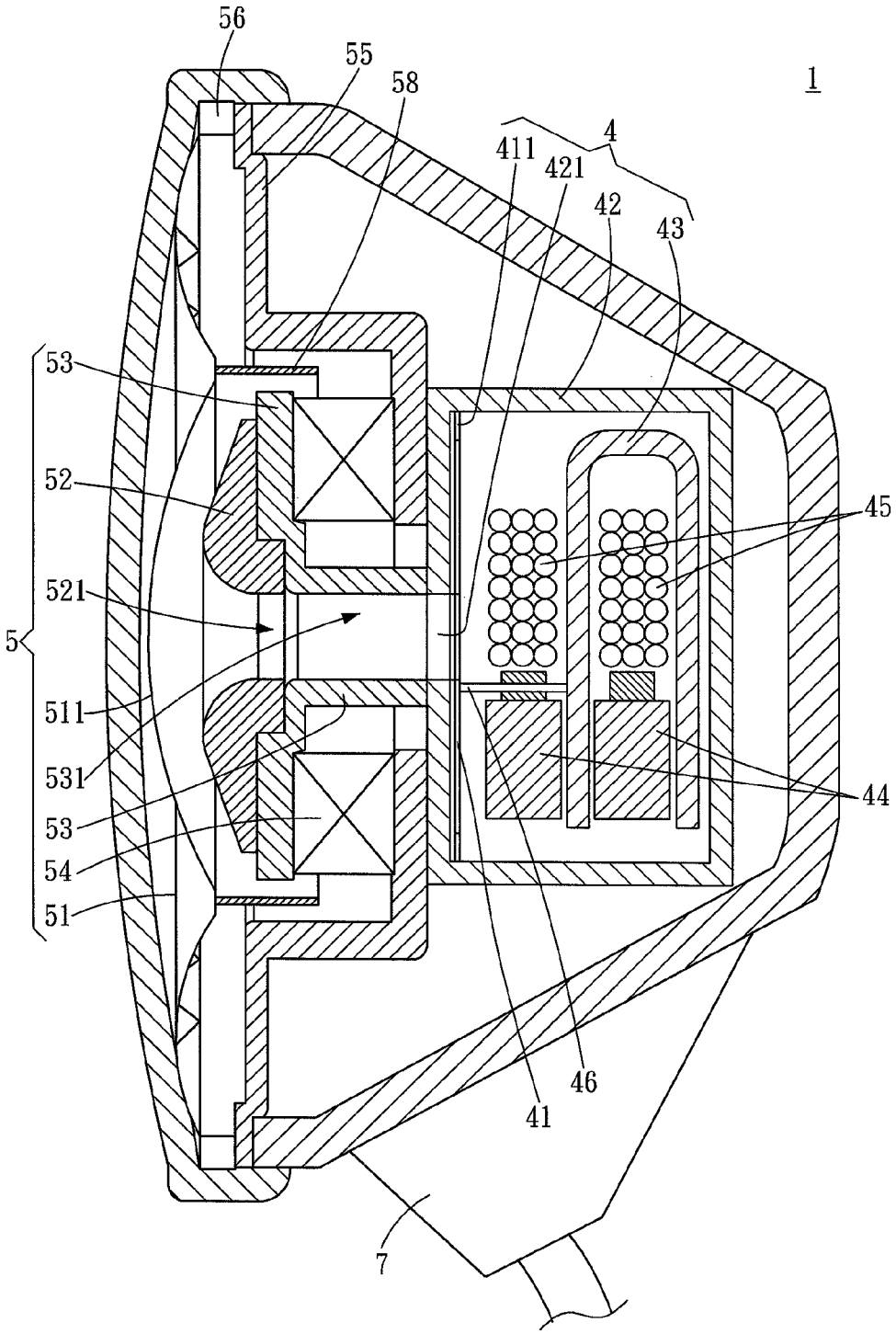
FIG. 5 is a cross-sectional view of the dual-frequency coaxial earphone of the second embodiment.

FIG. 4 and FIG. 5 show a second embodiment of a dual-frequency coaxial earphone 1 of the disclosure. FIG. 4 is an exploded view of the second embodiment of the disclosure and FIG. 5 is a cross-sectional view of the second embodiment of the disclosure.

As shown, the second embodiment is generally structurally similar to the first embodiment, except that the structure of the moving coil loudspeaker unit. In this embodiment, the moving coil loudspeaker unit 5 is substantially consisting of a moving coil vibrating diaphragm 51, an acoustic transmitting member 52, an inner yoke 53, an annular magnet 54, an outer yoke 55, a fastening ring 56 and a moving voice coil 58.

The moving coil vibrating diaphragm 51 is assembled to face to the acoustic output orifice 211 and includes a central vibrating portion 511. The acoustic transmitting member 52 is formed as a hollow structure and has an acoustic transmitting hole 521 opened therein. And, the acoustic transmitting hole 521 corresponds to the central vibrating portion 511. Preferably, the acoustic transmitting hole 521 corresponds to the center of the central vibrating portion 511. The acoustic transmitting member 52 is assembled on the inner yoke 53. The annular magnet 54 is disposed between the inner yoke 53 and the outer yoke 55.

Here, the inner yoke 53 has an inner axial tube 531 formed as a hollowed structure, and the outer yoke 55 has a central hole 551. The outer diameter of the inner axial tube 531 is smaller than the inner diameter of the central hole 551, so that the inner axial tube 531 can be inserted into the annular magnet 54 and the central hole 551 of the outer yoke 55 sequentially. In addition, the acoustic transmitting hole 521 of the acoustic transmitting member 52 coaxially corresponds to and communicates with the inner axial tube 531.

The fastening ring 56 is assembled on the outer yoke 55 to fasten the moving coil vibrating diaphragm 51. The moving voice coil 58 is assembled on the moving coil vibrating diaphragm 51 and axially and correspondingly extends to the space defined between the outer yoke 55 and the inner yoke 53.

As shown in FIG. 5, the axis line of the acoustic transmitting hole 521 corresponds to the center of the moving coil vibrating diaphragm 51 and the center of the armature vibrating diaphragm 41. Preferably, the center of the armature vibrating diaphragm 41 and the center of the moving coil vibrating diaphragm 51 are located on the axis line of the acoustic transmitting hole 521, but embodiments of the disclosure are not limited thereto.

Additionally, the balanced armature loudspeaker unit 4 has a circuit board 6 assembled on the side thereof. The circuit board 6 has a frequency dividing circuit assembled thereon to divide the frequency-mixed input signals of the signal cable 7 into the high frequency output signals and the low frequency output signals to apply for the armature voice coil 45 and the moving voice coil 58, respectively.

Here, the structures of the moving coil loudspeaker unit 5 and assembling of the circuit board 6 described above are only examples, but embodiments of the disclosure are not limited thereto.

Figure 6:
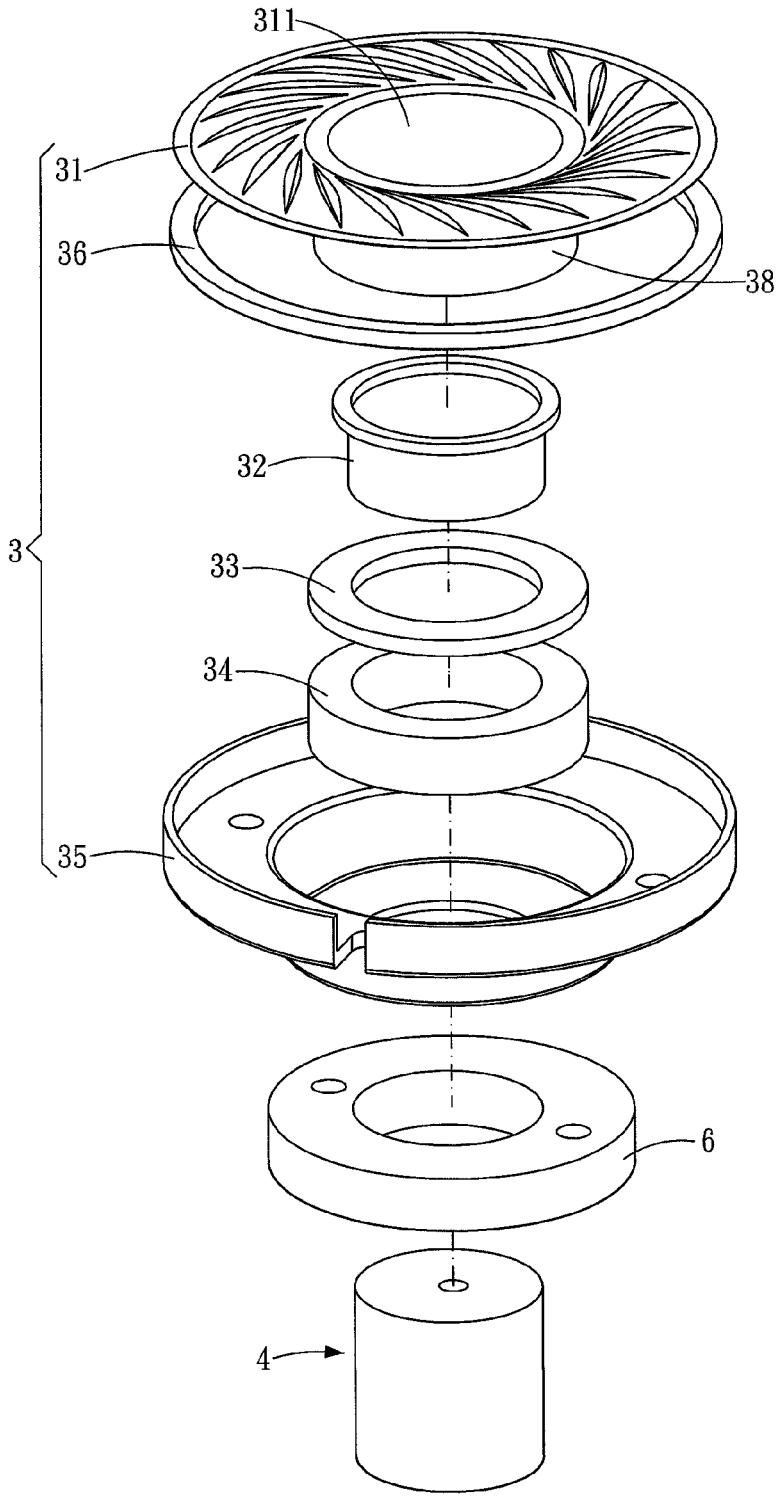
FIG. 6 is an exploded view of a dual-frequency coaxial earphone of a third embodiment.
Figure 7:
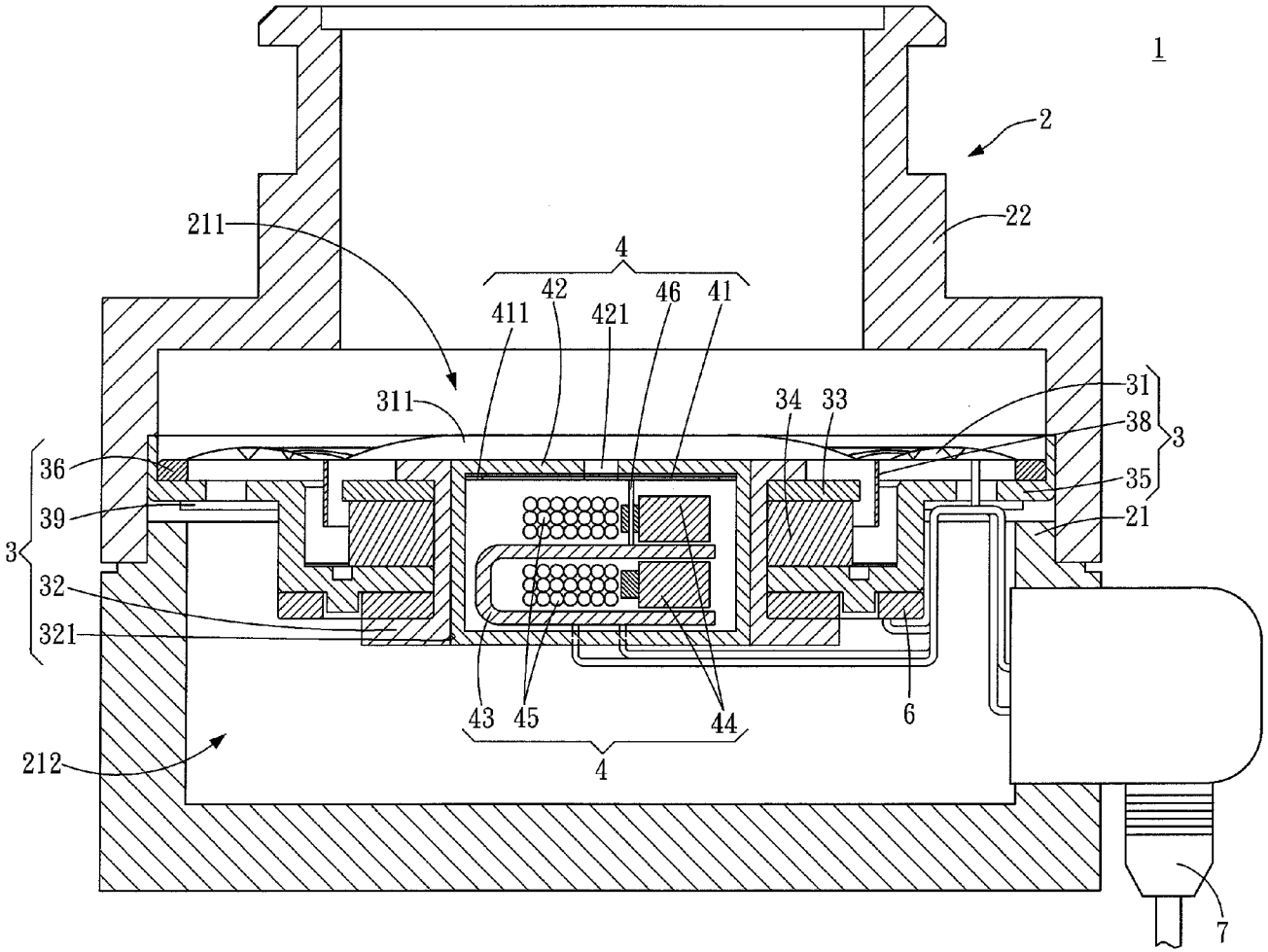
FIG. 7 is a cross-sectional view of the dual-frequency coaxial earphone of the third embodiment.

FIG. 6 and FIG. 7 show a third embodiment of a dual-frequency coaxial earphone 1 of the disclosure. FIG. 6 is an exploded view of the third embodiment of the disclosure and FIG. 7 is a cross-sectional view of the third embodiment of the disclosure.

As shown, the third embodiment is generally structurally similar to the first embodiment, except that the structure of the moving coil loudspeaker unit and the position of the balanced armature loudspeaker unit. In this embodiment, the balanced armature loudspeaker unit 4 is securely assembled in the acoustic transmitting hole 321 of the moving coil loudspeaker unit 3 and integrally formed as a whole with the moving coil loudspeaker unit 3. That is, one end of the moving coil loudspeaker unit 3 is faced to the acoustic output orifice 211 and has the balanced armature loudspeaker unit 4 securely assembled therein. And, the armature vibrating diaphragm 41 is disposed in the acoustic transmitting hole 321 and the moving coil vibrating diaphragm 31 is disposed at one end of the acoustic transmitting member 32, so that the armature vibrating diaphragm 41 is located inside the acoustic transmitting member 32 while the moving coil vibrating diaphragm 31 is located outside the acoustic transmitting member 32.

Consequently, the high frequency acoustic waves generated from the armature vibrating diaphragm 41 are transmitted to the central vibrating portion 311 directly so as to supplement the high acoustic frequency extensions the moving coil vibrating diaphragm 31 lacks. Additionally, the acoustic frequency of the balanced armature loudspeaker unit 4 and the acoustic frequency of the moving coil loudspeaker unit 3 have the same phase and are outputted simultaneously, so that the different frequencies from the balanced armature loudspeaker unit 4 and the moving coil loudspeaker unit 3 can be separated, so that the intermodulation distortion issue between the high acoustic frequency and the low acoustic frequency can be efficiently improved.

Furthermore, in this embodiment, in order to securely assemble the balanced armature loudspeaker unit 4 in the acoustic transmitting hole 321 of the moving coil loudspeaker unit 3, the sizes or the inner diameters of the components of the moving coil loudspeaker unit 3, like the acoustic transmitting member 32, the washer 33, the annular magnet 34, the outer yoke 35, the circuit board 6 and other components have to be enlarged so as to be correspondingly sleeved onto the balanced armature loudspeaker unit 4. Otherwise, the size of the balanced armature loudspeaker unit 4 can be reduced, so that the size of the earphone can be miniaturized.

Here, the structures of the moving coil loudspeaker unit 3 and the balanced armature loudspeaker unit 4 described above are only examples, but embodiments of the disclosure are not limited thereto.

Figure 8:
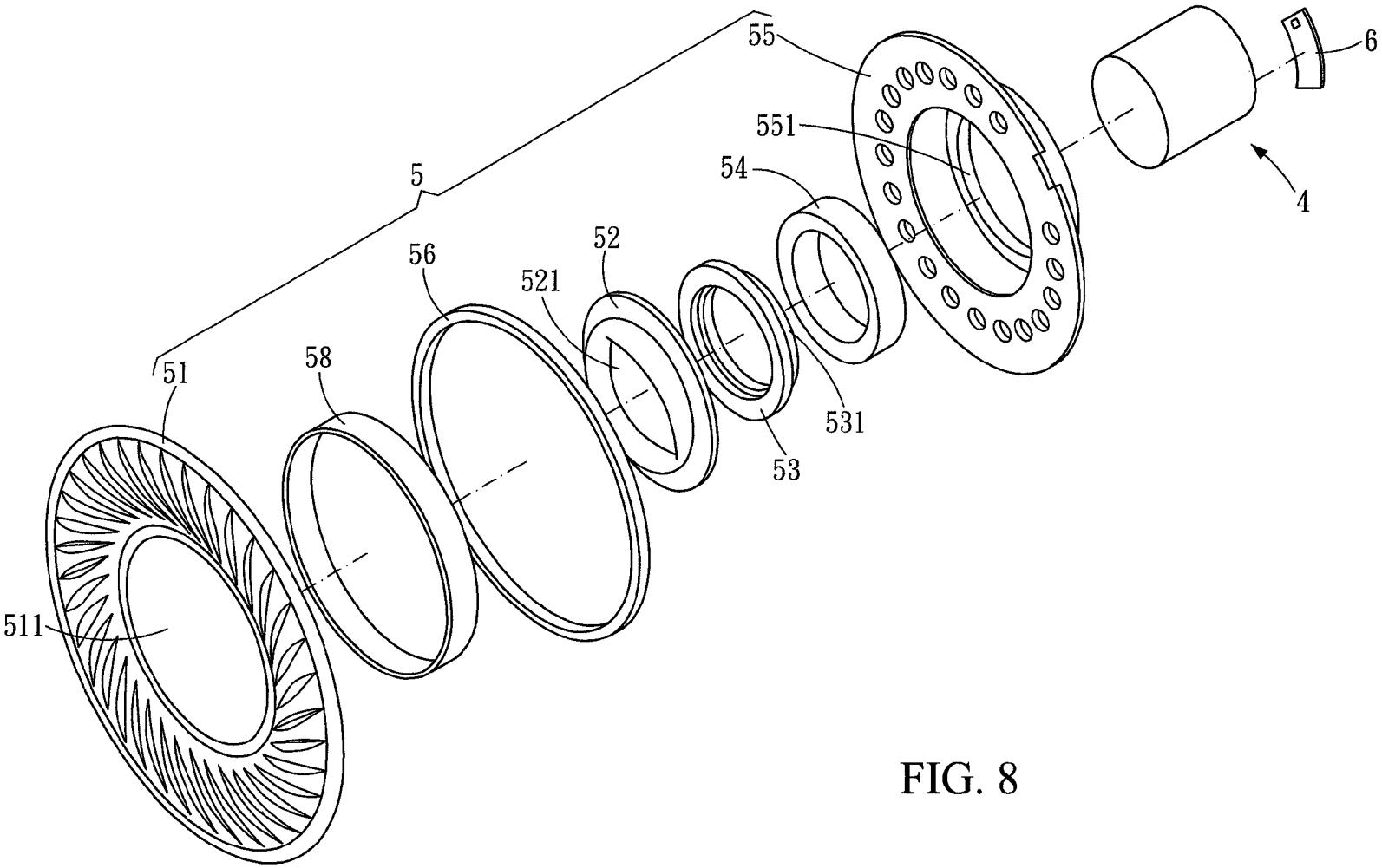
FIG. 8 is an exploded view of a dual-frequency coaxial earphone of a fourth embodiment.
Figure 9:
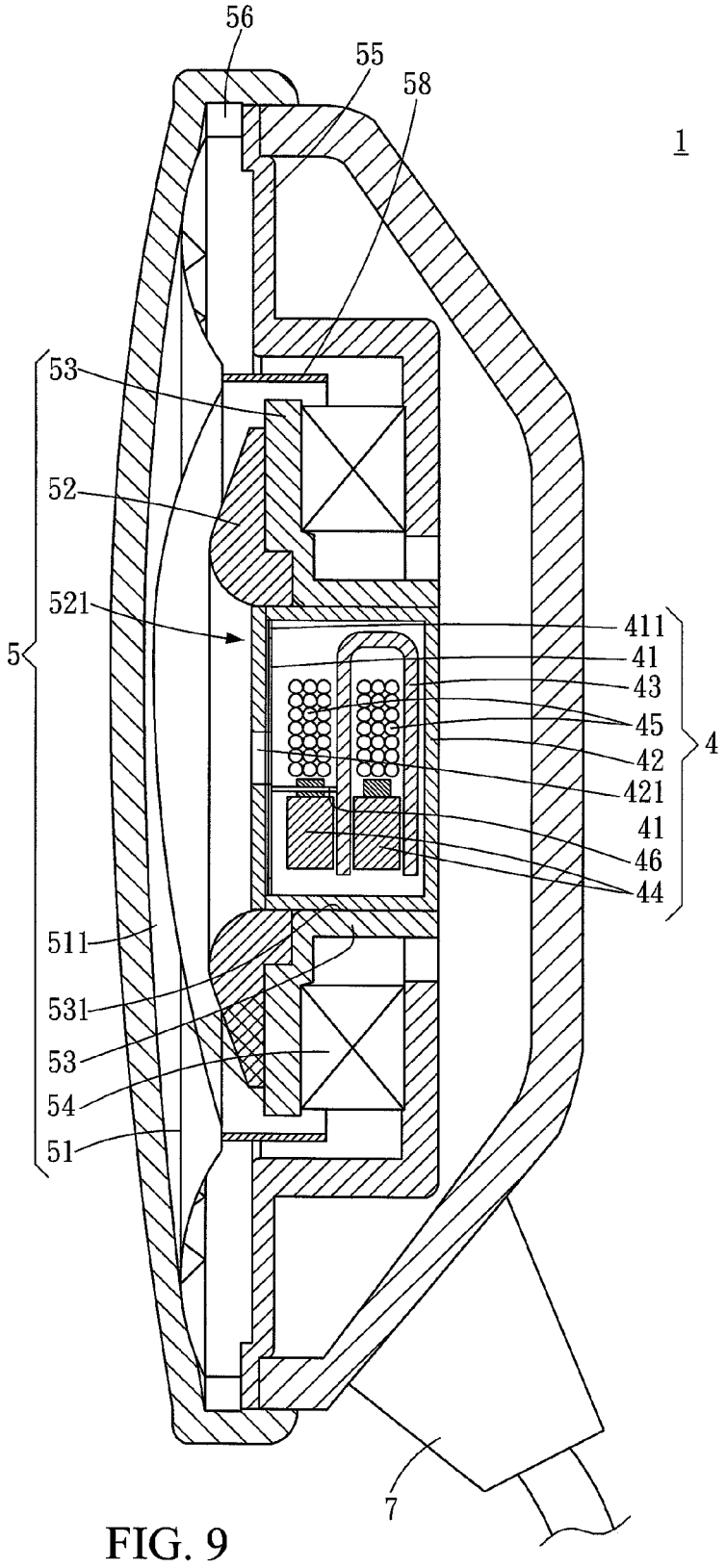
FIG. 9 is a cross-sectional view of the dually coaxial earphone of the fourth embodiment.

FIG. 8 and FIG. 9 show a fourth embodiment of a dual-frequency coaxial earphone of the disclosure. FIG. 8 is an exploded view of the fourth embodiment of the disclosure and FIG. 5 is a cross-sectional view of the fourth embodiment of the disclosure.

As shown, the fourth embodiment is generally structurally similar to the second embodiment, except that the position of the balanced armature loudspeaker unit 4. As shown in FIG. 9, in this embodiment, the inner axial tube 531 can be regarded as the extension of the acoustic transmitting member 52; in other words, the hollow portion of the inner axial tube 531 is one part of the acoustic transmitting hole 521 which has the balanced armature loudspeaker unit 4 securely assembled therein.

Additionally, in this embodiment, in order to securely assemble the balanced armature loudspeaker unit 4, the sizes or the inner diameters of the components of the moving coil loudspeaker unit 5, like the acoustic transmitting member 52, the acoustic transmitting hole 521, the inner yoke 53, the annular magnet 54, the moving voice coil 58 and other components have to be enlarged so as to be correspondingly sleeved onto the balanced armature loudspeaker unit 4. Otherwise, the size of the balanced armature loudspeaker unit 4 can be reduced, so that the size of the earphone can be miniaturized.

According to the dual-frequency coaxial earphone of the disclosure, the balanced armature loudspeaker unit is securely assembled to the rear end of the moving coil loudspeaker unit, so that the balanced armature loudspeaker unit and the moving coil loudspeaker unit are formed integrally as a whole; or, the balanced armature loudspeaker unit is securely assembled in the acoustic transmitting hole of the moving coil loudspeaker unit, so that the balanced armature loudspeaker unit and the moving coil loudspeaker unit are formed integrally as a whole. Based on this, because the acoustic waves generated from the balanced armature loudspeaker unit are transmitted to the central vibrating portion of the moving coil loudspeaker unit directly or through the acoustic transmitting hole, the acoustic waves generated from the balanced armature loudspeaker unit and the acoustic waves generated from the moving coil loudspeaker unit have the same phase and are outputted simultaneously, and the different frequencies from the balanced armature loudspeaker unit and the moving coil loudspeaker unit can be separated, so that the intermodulation distortion issue between the high acoustic frequency and the low acoustic frequency can be efficiently improved with the size of the earphone being miniaturized.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A dual-frequency coaxial earphone, comprising:

an earphone housing, having a receiving space and an acoustic output orifice, the receiving space communicating with the acoustic output orifice;

a moving coil loudspeaker unit, disposed in the receiving space, comprising a moving coil vibrating diaphragm and an acoustic transmitting member, the moving coil vibrating diaphragm being assembled to face to the acoustic output orifice and comprising a central vibrating portion, the acoustic transmitting member comprising an acoustic transmitting hole corresponding to the central vibrating portion; and a balanced armature loudspeaker unit, corresponding to the moving coil loudspeaker unit, comprising an armature vibrating diaphragm corresponding to the acoustic transmitting hole, so that the armature vibrating diaphragm and the moving coil vibrating diaphragm are respectively disposed at two ends of the acoustic transmitting member, wherein the balanced armature loudspeaker unit further comprises an armature, an armature magnet, an armature voice coil and a linking-up member, parts of the armature are inserted into the armature magnet and the armature voice coil, the linking-up member connects to the armature magnet and the armature vibrating diaphragm;

wherein high frequency acoustic waves generated from the armature vibrating diaphragm are transmitted to the central vibrating portion through the acoustic transmitting hole so as to supplement high acoustic frequency extensions the moving coil vibrating diaphragm lacks.

2. The dual-frequency coaxial earphone according to claim 1, wherein the center of the armature vibrating diaphragm corresponds to the center of the moving coil vibrating diaphragm.

3. The dual-frequency coaxial earphone according to claim 2, wherein the center of the armature vibrating diaphragm and the center of the moving coil vibrating diaphragm are located on an axis line of the acoustic transmitting a hole.

4. The dual-frequency coaxial earphone according to claim 1, the moving coil loudspeaker unit further comprises a washer, an annular magnet and an outer yoke, the annular magnet is disposed on the outer yoke and the washer is disposed on the surface of the annular magnet, the washer, the annular magnet and the outer yoke are riveted by the acoustic transmitting member.

5. The dual-frequency coaxial earphone according to claim 4, wherein the moving coil loudspeaker unit further comprises a fastening ring assembled on the outer yoke.

6. The dual-frequency coaxial earphone according to claim 4, wherein the moving coil loudspeaker unit further comprises a moving voice coil assembled on the moving coil vibrating diaphragm and sleeved to the washer.

7. The dual-frequency coaxial earphone according to claim 1, wherein the moving coil loudspeaker unit further comprises an inner yoke, an annular magnet and a outer yoke, the inner yoke comprising an inner axial tube, the outer yoke comprising a central hole, the inner axial tube inserts into the annular magnet and the central hole of the outer yoke.

8. The dual-frequency coaxial earphone according to claim 7, wherein the acoustic transmitting hole coaxially corresponds to the inner axial tube.

9. The dual-frequency coaxial earphone according to claim 7, wherein the moving coil loudspeaker unit further comprises a fastening ring assembled on the outer yoke.

10. A dual-frequency coaxial earphone, comprising:

an earphone housing, having a receiving space and an acoustic output orifice, the receiving space communicating with the acoustic output orifice;

a moving coil loudspeaker unit, disposed in the receiving space, comprising a moving coil vibrating diaphragm and an acoustic transmitting member, the moving coil vibrating diaphragm being assembled to face to the acoustic output orifice and comprising a central vibrating portion, the acoustic transmitting member comprising an acoustic transmitting hole corresponding to the central vibrating portion; and a balanced armature loudspeaker unit, disposed in the acoustic transmitting hole, comprising an armature vibrating diaphragm corresponding to the moving coil vibrating diaphragm, wherein the balanced armature loudspeaker unit further comprises an armature, an armature magnet, an armature voice coil and a linking-up member, parts of the armature are inserted into the armature magnet and the armature voice coil, the linking-up member connects to the armature magnet and the armature vibrating diaphragm;

wherein high frequency acoustic waves generated from the armature vibrating diaphragm are transmitted to the central vibrating portion through the acoustic transmitting hole so as to supplement high acoustic frequency extensions the moving coil vibrating diaphragm lacks.

11. The dual-frequency coaxial earphone according to claim 10, wherein the center of the armature vibrating diaphragm corresponds to the center of the moving coil vibrating diaphragm.

12. The dual-frequency coaxial earphone according to claim 11, wherein the center of the armature vibrating diaphragm and the center of the moving coil vibrating diaphragm are located on an axis line of the acoustic transmitting hole.

13. The dual-frequency coaxial earphone according to claim 10, the moving coil loudspeaker unit further comprises a washer, an annular magnet and an outer yoke, the annular magnet is disposed on the outer yoke and the washer is disposed on the surface of the annular magnet, the washer, the annular magnet and the outer yoke are riveted by the acoustic transmitting member.

14. The dual-frequency coaxial earphone according to claim 13, wherein the moving coil loudspeaker unit further comprises a fastening ring assembled on the outer yoke.

15. The dual-frequency coaxial earphone according to claim 13, wherein the moving coil loudspeaker unit further comprises a moving voice coil assembled on the moving coil vibrating diaphragm and sleeved to the washer.

16. The dual-frequency coaxial earphone according to claim 10, wherein the moving coil loudspeaker unit further comprises an inner yoke, an annular magnet and a outer yoke, the inner yoke comprising an inner axial tube, the outer yoke comprising a central hole, the inner axial tube inserts into the annular magnet and the central hole of the outer yoke.

17. The dual-frequency coaxial earphone according to claim 16, wherein the acoustic transmitting hole coaxially corresponds to the inner axial tube.

18. The dual-frequency coaxial earphone according to claim 16, wherein the moving coil loudspeaker unit further comprises a fastening ring assembled on the outer yoke.

* * * * *